US006823921B2

(12) United States Patent
Duschek

(10) Patent No.: US 6,823,921 B2
(45) Date of Patent: Nov. 30, 2004

(54) DEVICE AND METHOD FOR APPLYING A SECURITY ELEMENT TO A LABEL

(75) Inventor: Detlef Duschek, Sensbachtal (DE)

(73) Assignee: Checkpoint Systems International GmbH (DE)

( * ) Notice: Subject to any disclaimer, the term of this patent is extended or adjusted under 35 U.S.C. 154(b) by 0 days.

(21) Appl. No.: 10/273,102

(22) Filed: Oct. 17, 2002

(65) Prior Publication Data

US 2003/0037872 A1 Feb. 27, 2003

Related U.S. Application Data

(63) Continuation of application No. PCT/EP01/03900, filed on Apr. 5, 2001.

(30) Foreign Application Priority Data

Apr. 19, 2000 (DE) ..... 100 19 438

(51) Int. Cl.[7] ..... B65C 9/10; B65C 9/12

(52) U.S. Cl. ..... 156/556; 156/557; 156/563; 156/564; 156/566; 156/567; 156/571

(58) Field of Search ..... 156/556, 564, 156/566, 567, 569, 570, 571, 557, 563; 340/551, 572

(56) References Cited

U.S. PATENT DOCUMENTS

| | | | | |
|---|---|---|---|---|
| 3,537,934 A | * | 11/1970 | Munch | 156/364 |
| 3,871,639 A | | 3/1975 | Felix | |
| 4,602,977 A | * | 7/1986 | Voltmer et al. | 156/449 |
| 4,605,459 A | * | 8/1986 | Voltmer et al. | 156/215 |
| 4,652,863 A | | 3/1987 | Hultman | |
| 5,429,044 A | | 7/1995 | Giori et al. | |
| 5,614,278 A | | 3/1997 | Chamberlain et al. | |
| 5,867,102 A | | 2/1999 | Souder et al. | |
| 5,897,741 A | | 4/1999 | Mills et al. | |
| 6,234,231 B1 | * | 5/2001 | Boss et al. | 156/556 |

FOREIGN PATENT DOCUMENTS

| | | |
|---|---|---|
| DE | 42 12 988 A1 | 10/1993 |
| DE | 196 50 611 A1 | 6/1998 |
| EP | 0 592 780 A2 | 4/1994 |
| EP | 0 673 007 A2 | 9/1995 |
| GB | 2310977 A | 9/1997 |
| WO | WO 97/14126 | 4/1997 |

* cited by examiner

*Primary Examiner*—Sue A Purvis
(74) *Attorney, Agent, or Firm*—Caesar, Rivise, Bernstein, Cohen & Pokotilow, Ltd.

(57) ABSTRACT

The device (1) comprises individual stations, which are passed through in succession, and consisting of: a removal station (4) for labels (2), whereby one label (2) at a time is removed from a label stack (7); an application station (5), in which at least one securing element (3 is applied to the label (2), and of; a storage station (6) for the labels (2) provided with the securing elements (3), whereby said labels (2) provided with the securing elements (3) are placed in a label stack (9).

5 Claims, 3 Drawing Sheets

DEVICE AND METHOD FOR APPLYING A SECURITY ELEMENT TO A LABEL

CROSS-REFERENCE TO RELATED APPLICATIONS

This application is a continuation of International Application No. PCT/EP01/03900, filed Apr. 5, 2001, and the disclosure of which is incorporated herein by reference.

BACKGROUND OF THE INVENTION

This invention relates to a device and a method for applying a security element for electronic article surveillance to a label, in particular a bottle label.

Labels for electronic article surveillance conventionally exist as adhesive labels and are arranged on an endless carrier web before being applied to the articles requiring protection or to their packaging. Up to now, endless carrier webs with security elements have been offered for sale by manufacturers in roll form. The security elements are applied to the articles requiring protection with the aid of automatic or semi-automatic labeling apparatus, the labeling operation customarily being performed directly in the department stores where the articles are passed on to the end consumers.

Considering that the operation of applying the security elements is time-intensive and hence also cost-intensive, there have already been numerous proposals to integrate the security elements in the articles requiring protection or in their packaging during production. This type of article protection is referred to as source protection. In connection with source protection the only approach known so far is to supply the security elements on an endless carrier web, to detach them singly from the carrier web and insert them in the articles or their packaging. A method for manufacturing an endless strip with security elements is known from EP 0 680 011 A2, for example.

BRIEF SUMMARY OF THE INVENTION

It is an object of the present invention to equip labels, in particular bottle labels, economically with security elements for electronic article surveillance.

As regards the device, the object of the invention is accomplished in that the device comprises several stations that are passed through in succession: a pick-up station for labels in which one label at a time is picked up from a stack of labels; an applicator station in which at least one security element at a time is applied to the label; and a storage station for the labels equipped with the security elements, the labels being deposited in a label stack.

A low-cost configuration of the device of the invention provides for the individual stations of the device to have essentially the same construction. In particular the stations involved are magazines in which the labels and the security elements are arranged in the form of stacks.

According to a preferred embodiment of the device of the invention provision is made for suction heads which are exposed to pressure below atmospheric in phases, meaning intermittently, and which transfer the labels and the labels with the security elements from one station to the next. According to a first alternative embodiment of the device of the invention the top-most or front-most label is picked up from the supply station. The pick-up is performed by a suction head which communicates with a vacuum source so that a pressure below atmospheric prevails at its contact face. The suction head is then moved to the applicator station. On the way to the applicator station the label is coated in a selected area with adhesive. At the applicator station the top-most or front-most security element of the stack 8 comes into contact with the adhesive and adheres to the adhesive-coated area of the label. Subsequently the suction head and the label equipped with the security element are transferred to the storage station. As soon as the label is inserted in the stack 9 as the top-most or front-most label, the suction air is switched off, releasing the label equipped with a security element.

While in the case of the previously described embodiment the security elements are arranged in a stack and transferred to the labels by means of an adhesive, an alternative embodiment of the device of the invention provides for the security elements to be adhered singly in succession on a carrier web. The carrier web with the security elements is unwound from a supply reel and diverted around a dispensing lip at which the security elements are lifted off the carrier web; the carrier web is then re-wound onto a take-up reel.

The dispensing lip is arranged in the direct vicinity of the suction head. The security element thus comes into contact with the label which is fixed on the contact face of the suction head, and remains adhered to it subsequently because the adhesion to the label is greater than the adhesion to the carrier web.

As regards the method, the object of the invention is accomplished by the steps of picking up one label at a time from a label stack, applying at least one security element to the label, and depositing the label equipped with the security element in a label stack.

A preferred further aspect of the method of the invention includes the steps of applying an adhesive to the label at least in a selected area thereof after it has been taken from the label stack, and adhesive-bonding the security element to the label area provided with the adhesive.

An alternative embodiment proposes applying a security element coated with an adhesive to the label after the label has been taken from the label stack. In this case the intermediate step of applying a coating of adhesive to the label is eliminated.

To be able to perform the method continuously an advantageous further aspect of the method of the invention provides for the labels to be moved essentially on a circular path in succession from one station to the next.

Labels, in particular bottle labels which have been equipped with a security element in accordance with the method of the invention, are characterized in that said security elements are strip elements, resonant-circuit or acousto-magnetic elements. It is, of course, also possible for elements referred to as ID elements with an integrated circuit and an antenna coil (RF/ID circuit) to be applied to the labels. Such labels not only provide information as to the presence or absence of a protected article in the area subject to surveillance but can also be used to transmit any other information.

According to a preferred embodiment of the label manufactured in accordance with the method of the invention the front side of the label has an imprint while the security element is applied to the rear side of the label. After the label is applied to an article, e.g., a bottle, the security element can only be removed from the article by destroying the label. With this so-called source protection it is possible to protect articles more effectively from theft. Furthermore, the source protection is economical because it can be performed largely by automatic means during the production of the articles or their packaging.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
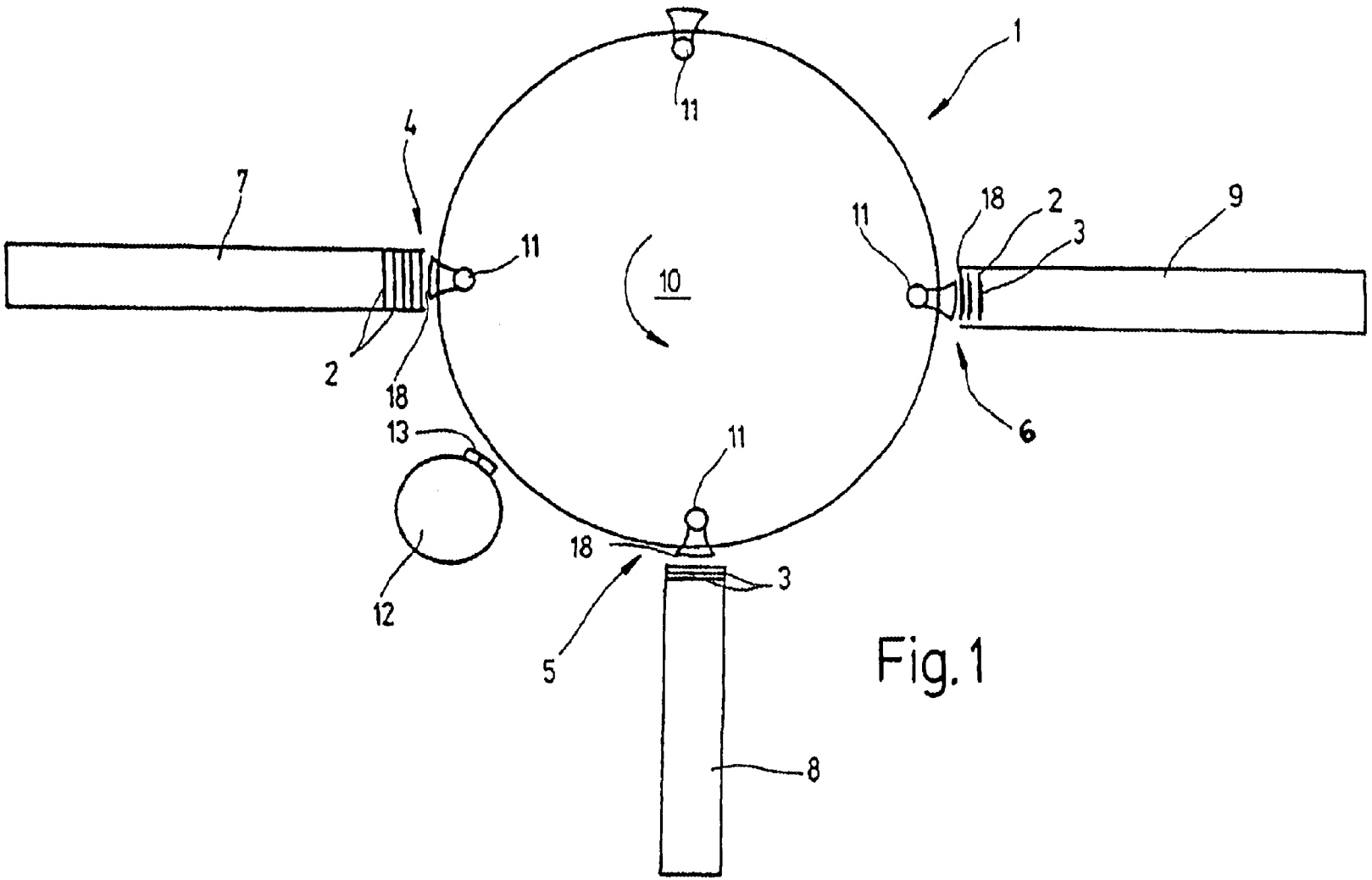
FIG. 1 is a schematic representation of a first embodiment of the device of the invention.

FIG. 1 shows a schematic representation of a first embodiment of the device 1 according to the invention. Arranged on a rotary unit 10 (=carousel) are four suction heads 11 moving on a circular path when the unit 10 rotates. Arranged tangent to the circular path described by the suction heads are three stations: the pick-up station 4, the applicator station 5 and the storage station 6. The stations 4, 5, 6 are, respectively, stacks 7, 8, 9 of labels 2, of security elements 3 and of labels 2 with applied security elements 3. The labels 2; 3; 2,3 are arranged in magazines open at the front and are moved into the correct pick-up position by means of an automatic feed. Such stations 7, 8, 9 are in principle already well known from the bottle labeling sector.

Once a suction head 11 reaches the position opposite the pick-up station 4 it is activated. The suction air and the rotation of the rotary unit 10 are controlled by means of a control unit which is not specially illustrated in the drawings. The vacuum causes the front-most label 2 to be drawn against the contact face 18 of the suction head where it is securely held in place. While the label 2 is passing the adhesive station 12, an adhesive material is applied to a previously selected area. To specifically define this area the adhesive station is provided with a corresponding elevation 13 which, when in contact with the label 2, applies adhesive to the rear side of the label 2. The adhesive station 12 preferably performs a pivotal motion, whereby adhesive is applied to the label 2 during rotation of the rotary unit 10.

At the applicator station 5 a security element 3 is placed in the area previously coated with adhesive. At the storage station 6 the suction air is cut off from the suction head 11. This causes the label 2 with the security element 3 to be released and pressed into the stack 9.

Figure 2:
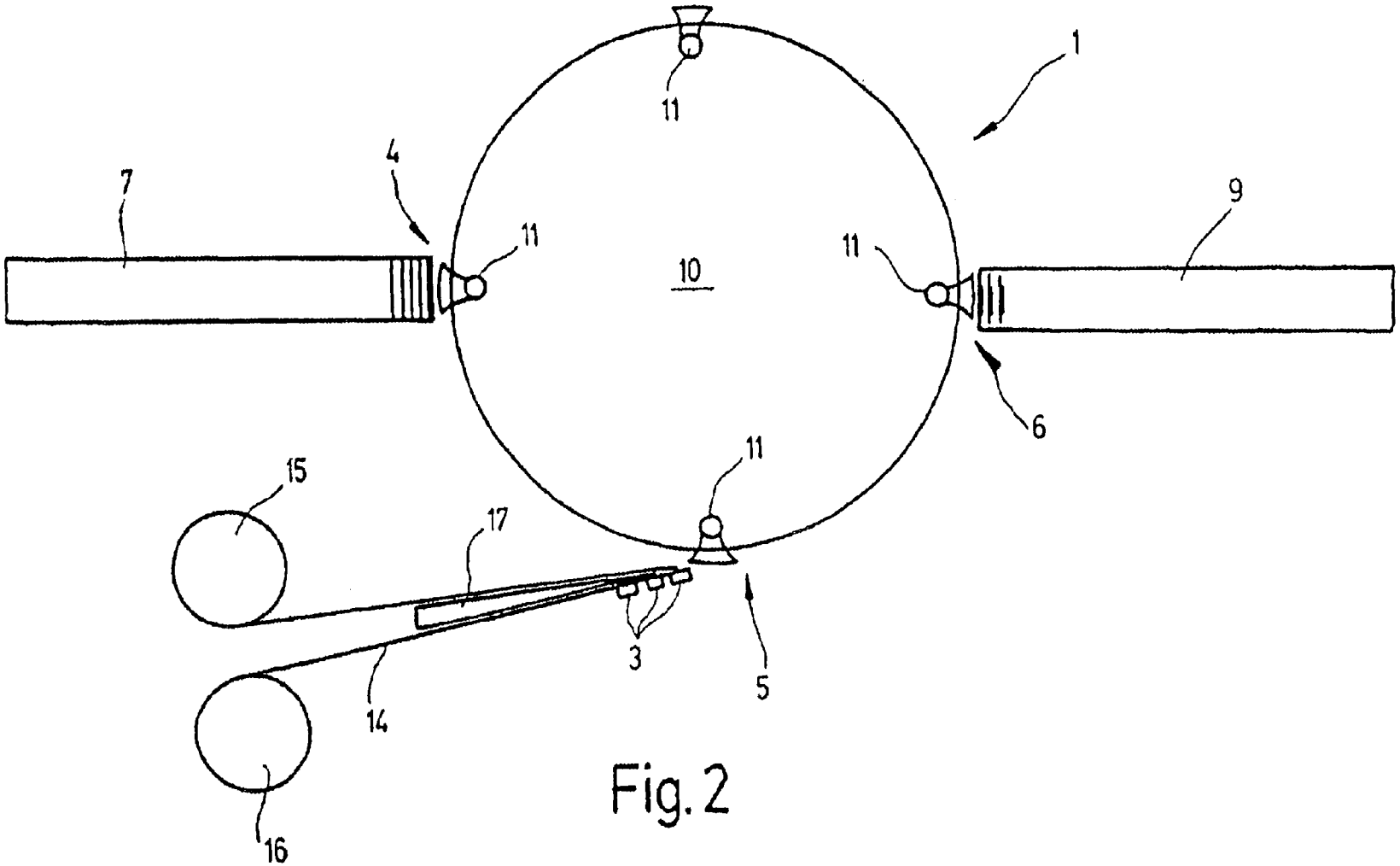
FIG. 2 is a schematic representation of a second embodiment of the device of the invention.

The embodiment of the device of the invention shown in FIG. 2 is equipped with four suction heads 11 and three stations 4, 5, 6. It will be understood, of course, that the number of suction heads 11 and the number of stations 4, 5, 6 may be increased, resulting in higher costs on the one hand but permitting higher production rates on the other.

FIG. 2 shows a schematic representation of a second embodiment of the device 1 of the invention. Unlike the embodiment shown in FIG. 1 the security elements 3 in the applicator station 5 are not arranged in a stack 8 but are transferred to the labels 2 via a dispensing device. The dispensing device is comprised of a supply reel 16, a dispensing lip 17 and a take-up reel 15. Security elements 3 in the form of adhesive labels are applied to the carrier web 14. At the dispensing lip 17 the security elements 3 are lifted off the carrier web 14 and come into contact with the label 2. With the adhesion to the label 2 being greater than the adhesion to the carrier web 14, which is silicone tape for example, the security element 3 is applied to the label 2 presented at the applicator station 5.

A computing/control unit, which is not specially shown in FIG. 2, controls the feed of the security elements 3 and the rotation of the rotary unit 10 to ensure that the security elements 3 are transferred to the area selected on the labels 2.

While in the embodiments illustrated in the drawings the individual stations 4, 5, 6 are arranged on a circular path and reached by rotating the rotary unit 10 with the suction heads 11, the device according to the invention can be used just a well with the individual stations 4, 5, 6 arranged in a line one behind the other, for example.

Figure 3:
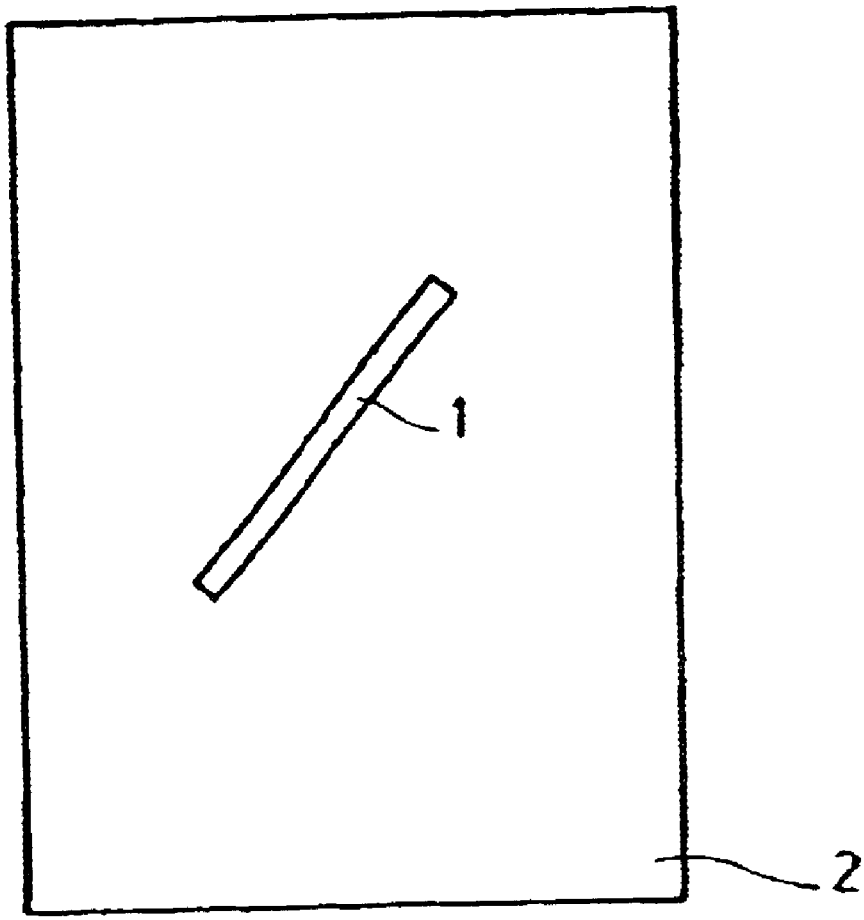
FIG. 3 is a plan view of a security element of the invention.

FIG. 3 shows a plan view of a label 2 of the invention having a security element 3 applied to it. The label 2 carries a security element 3 on its unprinted rear side. In the case illustrated the security element 3 is an element of the type referred to as strip element, which is manufactured from a soft magnetic material. As described in the foregoing, any other form of security element 3 for electronic article surveillance can be used to equip the labels 2 of the invention.

List of References

1 device of the invention
2 label
3 security element
4 pick-up station
5 applicator station
6 storage station
7 stack of labels 2
8 stack of security elements 3
9 stack of labels 2 with applied security elements 3
10 rotary unit
11 suction head
12 adhesive station
13 elevation
14 carrier web for security elements 3
15 supply reel
16 take-up reel
17 dispensing lip It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A device for applying a security element for electronic article surveillance to a label, comprising a plurality of stations that the devices pass through in succession, said stations comprising:

a pick-up station for labels in which one label at a time is picked up from a stack of labels, wherein each label is moved into a correct pick-un position by a feed;

an applicator station in which at least one security element at a time is applied to each label wherein each security element is moved into a correct position by a feed;

a storage station for the labels having the security elements thereon, each said label having the security element thereon being deposited in a label stack, said storage station comprising a magazine, into which each label having a security element thereon is deposited; and a plurality of suction heads which are exposed to pressure below atmospheric in phases between the pick-up station and the storage station, said suction heads disposed on a rotary unit which which transfer the labels from the pick-up station to the applicator station and which transfer the labels with the security elements from the applicator station to the storage station, said pick-up station, said applicator station and said storage station arranged tangent to a circular path upon which the suction heads travel.

2. The device as claimed in claim 1, wherein the pick-up, applicator and storage stations comprise magazines in which labels are moved into a correct pick-up position by means of an automatic feed.

3. The device as claimed in claim 1, wherein the security elements are arranged in a stack.

4. The device as claimed in claim 3, wherein between the label stack and the stack with security elements provision is made for an adhesive station which coats a selected area of the labels to which the security element is applied with adhesive.

5. The device as claimed in claim 1, wherein the applicator station is adapted to adhesive bond the security elements to a carrier material and apply the security elements to the selected area of the label by means of a dispensing lip.

* * * * *